US008303247B2

(12) United States Patent
Schlichting et al.

(10) Patent No.: US 8,303,247 B2
(45) Date of Patent: Nov. 6, 2012

(54) BLADE OUTER AIR SEAL

(75) Inventors: Kevin W. Schlichting, Storrs, CT (US); Melvin Freling, West Hartford, CT (US); James A. Dierberger, Hebron, CT (US)

(73) Assignee: United Technologies Corporation, Hartford, CT (US)

( * ) Notice: Subject to any disclaimer, the term of this patent is extended or adjusted under 35 U.S.C. 154(b) by 1379 days.

(21) Appl. No.: 11/945,285

(22) Filed: Nov. 27, 2007

(65) Prior Publication Data

US 2009/0169368 A1 Jul. 2, 2009

Related U.S. Application Data

(63) Continuation-in-part of application No. 11/850,690, filed on Sep. 6, 2007.

(51) Int. Cl.
*F01D 11/08* (2006.01)

(52) U.S. Cl. ..... 415/173.1; 416/174; 29/424; 29/889.1

(58) Field of Classification Search ..... 415/170.1, 415/173.1, 174, 200; 416/174
See application file for complete search history.

(56) References Cited

U.S. PATENT DOCUMENTS

| | | | | |
|---|---|---|---|---|
| 2,490,548 | A | 12/1949 | Schultz | |
| 4,573,872 | A * | 3/1986 | Nakata | 416/96 A |
| 4,728,257 | A * | 3/1988 | Handschuh | 415/136 |
| 5,048,288 | A * | 9/1991 | Bessette et al. | 60/226.1 |
| 5,064,727 | A | 11/1991 | Naik et al. | |
| 5,894,053 | A | 4/1999 | Fried | |
| 6,299,935 | B1 | 10/2001 | Park et al. | |
| 6,393,331 | B1 | 5/2002 | Chetta et al. | |
| 6,428,280 | B1 | 8/2002 | Austin et al. | |
| 6,435,824 | B1 | 8/2002 | Schell et al. | |
| 6,443,700 | B1 | 9/2002 | Grylls et al. | |
| 6,511,630 | B1 | 1/2003 | Cartier et al. | |
| 6,541,134 | B1 * | 4/2003 | Strangman et al. | 428/698 |
| 6,648,596 | B1 | 11/2003 | Grylls et al. | |
| 6,652,227 | B2 * | 11/2003 | Fried | 415/173.4 |
| 7,247,002 | B2 * | 7/2007 | Albrecht et al. | 416/224 |
| 2003/0170119 | A1 | 9/2003 | Fried | |
| 2005/0249602 | A1 | 11/2005 | Freling | |

FOREIGN PATENT DOCUMENTS

| | | | |
|---|---|---|---|
| DE | 10057187 | A1 | 5/2002 |
| EP | 0192162 | A2 | 8/1986 |
| EP | 0776985 | A1 | 6/1997 |
| EP | 1491657 | A1 | 12/2004 |

OTHER PUBLICATIONS

European Search Report for EP Patent Application No. 08252924.9, dated Jun. 7, 2011.

* cited by examiner

*Primary Examiner* — Edward Look
*Assistant Examiner* — Ryan Ellis
(74) *Attorney, Agent, or Firm* — Bachman & LaPointe, P.C.

(57) ABSTRACT

A turbine engine blade outer air seal segment has a body having a base portion. The base portion has a transversely concave ID face, a forward end, an aft end, and first and second circumferential edges. The body has at least one mounting hook. The body comprises a metallic member and a ceramic member. The ceramic member and metallic member are joined along the base portion with the ceramic member inboard of the metallic member.

20 Claims, 4 Drawing Sheets

BLADE OUTER AIR SEAL

CROSS REFERENCE TO RELATED APPLICATION

This is a continuation-in-part of Ser. No. 11/850,690, filed Sep. 6, 2007, and entitled MECHANICAL ATTACHMENT OF CERAMIC OR METALLIC FOAM MATERIALS, the disclosure of which is incorporated by reference herein as if set forth at length.

BACKGROUND

The disclosure relates to gas turbine engines. More particularly, the disclosure relates to casting of cooled shrouds or blade outer air seals (BOAS).

BOAS segments may be internally cooled by bleed air. For example, cooling air may be fed into a plenum at the outboard or outside diameter (OD) side of the BOAS. The cooling air may pass through passageways in the seal body and exit outlet ports in the inboard or inner diameter (ID) side of the body (e.g. to film cool the ID face). Air may also exit along the circumferential ends (matefaces) of the BOAS so as to be vented into the adjacent inter-segment region (e.g., to help cool feather seal segments sealing the adjacent BOAS segments).

An exemplary BOAS configuration includes a casting and an OD cover plate welded to the casting. Air passes from the plenum through holes in the cover plate and into one or more feed chambers/cavities in the BOAS from which the passageways extend. An exemplary BOAS is found in U.S. Pat. No. 6,393,331.

SUMMARY

One aspect of the disclosure involves a turbine engine blade outer air seal segment having a body having a base portion. The base portion has a transversely concave ID face, a forward end, an aft end, and first and second circumferential edges. The body has at least one mounting hook. The body comprises a metallic member and a ceramic member. The ceramic member and metallic member are joined along the base portion with the ceramic member inboard of the metallic member.

In various implementations, the metallic member may be made by casting. The ceramic member may be pre-formed and then secured to a base portion of the metallic member.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
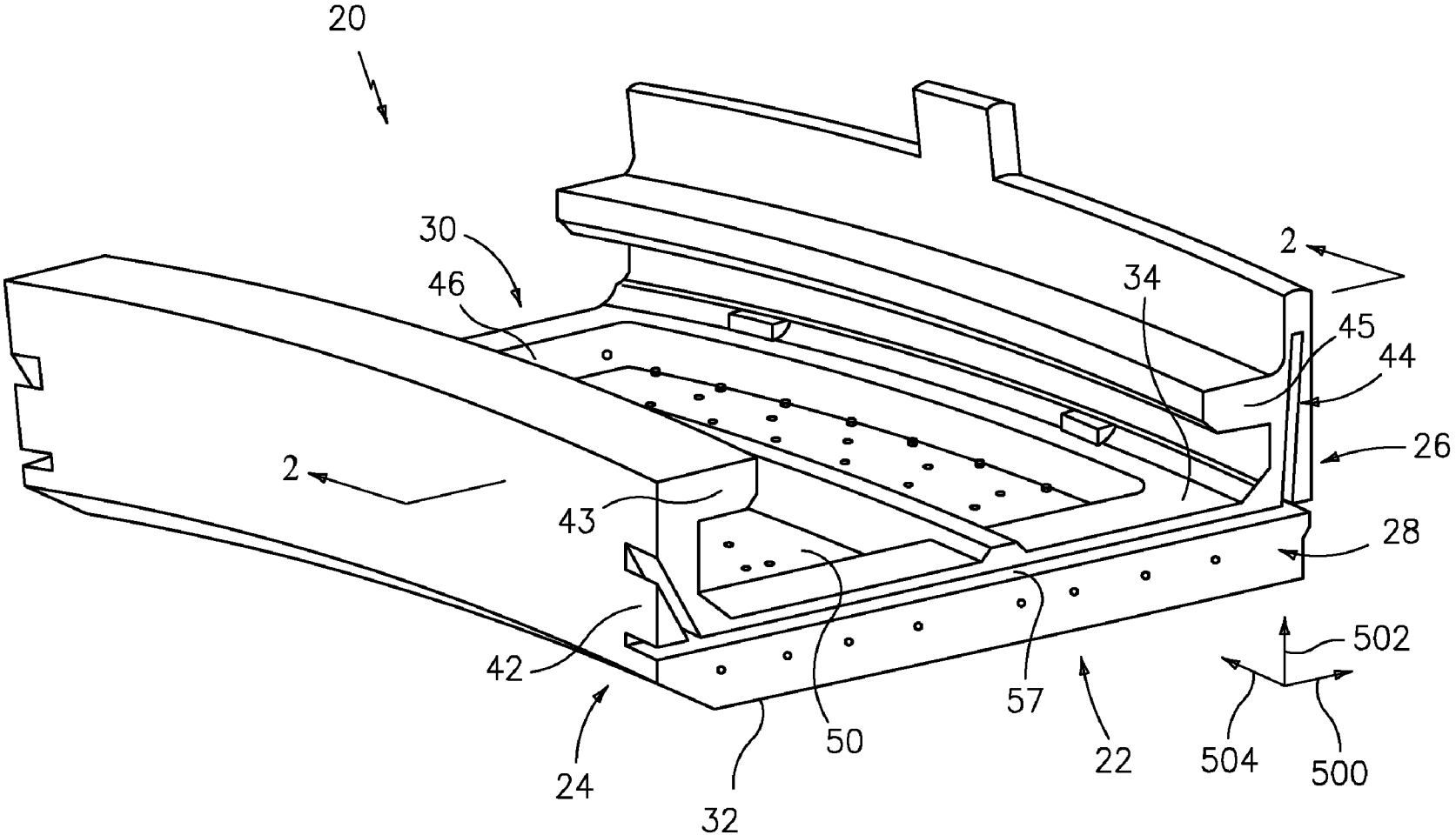
FIG. 1 is an isometric view of a blade outer airseal (BOAS).

FIG. 1 shows blade outer air seal (BOAS) 20 (with metering plate removed). The BOAS has a main body portion (or base portion) 22 having a leading/upstream/forward end 24 and a trailing/downstream/aft end 26. FIG. 1 further shows an approximate longitudinal/overall-downstream/aftward direction 500, an approximate radial outward direction 502, and an approximate circumferential direction 504. The body has first and second circumferential ends or matefaces 28 and 30. The body has an inner diameter (ID)/inboard face 32 and an outer diameter (OD)/outboard face 34.

To mount the BOAS to environmental structure 40 (FIG. 2) (e.g., the engine case), the exemplary BOAS has a plurality of mounting hooks. The exemplary BOAS has a single forward mounting hook 42 having a rearwardly-projecting distal portion 43 extending aft from the forward end 24. The exemplary BOAS has a single aft hook 44 having a forwardly-projecting portion 45 protruding forward from the aft end 26.

Figure 2:
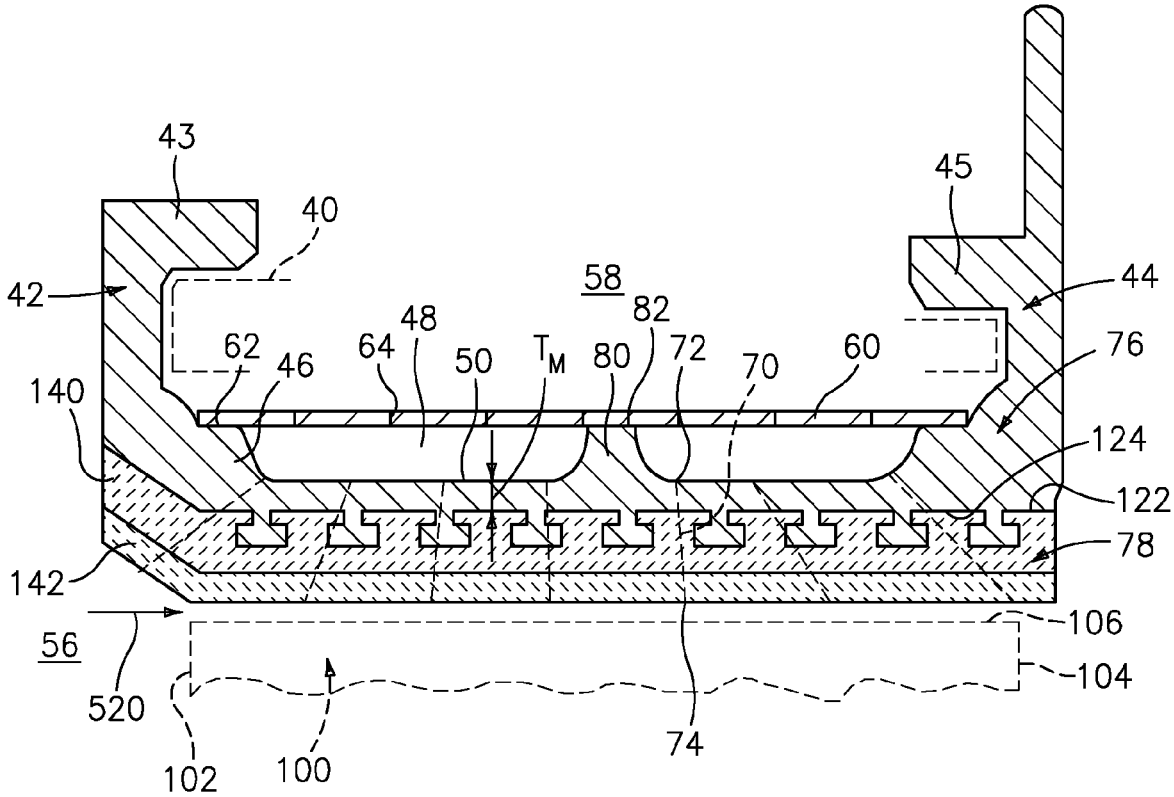
FIG. 2 is a longitudinal sectional view of the BOAS of FIG. 1 taken along line 2-2.

The BOAS has a wall structure 46 circumscribing/surrounding a recess/cavity 48 described in further detail below. The exemplary distal portion 43 of the forward hook 42 is formed as a full width rail/lip extending from a proximal portion of the hook 42 along front segment of the wall 46 (FIG. 2). The exemplary proximal portion of the aft hook 44 extends upward from an aft segment of the wall 46. A floor or base 50 of the chamber is locally formed by a central portion of the OD face 34.

A circumferential ring array of a plurality of the BOAS 20 may encircle an associated blade stage of a gas turbine engine. The assembled ID faces 32 thus locally bound an outboard extreme of the core flowpath 56 (FIG. 2). The BOAS 20 may have features for interlocking the array. For example, the matefaces 28 and 30 may have slots 57 (FIG. 1) for accommodating edges of seals (not shown) spanning junctions between adjacent BOAS 20. Other implementations may include complementary shiplap features or may include finger joints.

The BOAS may be air-cooled. For example, bleed air may be directed to a chamber 58 (FIG. 2) immediately outboard of a baffle/metering plate 60 that extends across the chamber 48. A perimeter portion of the underside of the baffle plate 60 may sit atop and be welded or brazed to a shoulder surface 62 of the wall 46. The bleed air may be directed through impingement feed holes 64 (shown schematically) in the plate 60 to the inboard portion of the chamber 48. Air may exit the chamber 48 through discharge passageways 70 (shown schematically). Exemplary passageways 70 extend from inlets 72 at the chamber 48 to outlets 74.

The exemplary BOAS includes a metal casting 76 (e.g., a nickel- or cobalt-based superalloy) and a ceramic member 78. The exemplary casting 76 includes a base portion which forms an outboard portion of the BOAS main body portion (base portion) 22. The exemplary casting includes a circumferential rib 80 in the chamber 48. The exemplary rib is full shoulder height so that its outboard surface 82 may contact the underside/ID surface of the plate (e.g., and be secured thereto as the plate is secured to the shoulder surface 62). The rib divides the portion of the chamber 48 below the plate 60 into a fore (sub)chamber/cavity and an aft (sub)chamber/cavity.

FIG. 2 schematically shows a blade 100 of the associated stage. The blade has an airfoil with a leading edge 102, a trailing edge 104, and a tip 106. Action of the airfoil imposes a pressure gradient to the airflow 520 passing downstream along the face 32.

The exemplary ID surface/face 32 is formed as the ID surface/face of the ceramic member 78. The ceramic member has an OD surface/face 122 secured to an ID surface/face 124 of the casting 126. The ceramic member 78 has first and second circumferential edges, a front/forward end, and an aft/rear end which align and combine with associated portions of the base portion of the casting 76 to form the first and second circumferential edges, a front/forward end, and an aft/rear end of the segment main body.

The exemplary ceramic member 78 is pre-formed and then secured to the pre-formed casting 76. Several securing features and methods are described below. The exemplary passageways 70 are drilled through the ceramic member and casting after assembly. Other manufacturing techniques are, however, possible.

The exemplary ceramic member 78 has two distinct layers of different properties: an outboard layer 140; and an inboard layer 142. Additional layers or a continuous gradient of property are also possible. Especially in the continuous gradient situation the layers may be defined, for example, by average properties (e.g., mean, median, or modal).

The exemplary layers 140 and 142 are of similar chemical composition but different density/porosity. The exemplary outboard layer 140 is of relatively high density and low porosity compared to the inboard layer 142. For example, the properties of the layer 142 may be particularly chosen to provide desired abradability by the blade tips 106. Its thickness (including any variation in thickness profile) may be selected to accommodate a desired or anticipated amount of abrading. The properties of the outboard layer 140 may be selected particularly for mechanical strength for attachment to the casting 76. Thermal properties of the ceramic member may be influenced by the properties of both layers. Thus, thermal/insulation considerations may influence both. However, depending on the physical situation (e.g., relative thicknesses) one of the layers may have more of an influence than the other.

Alternative embodiments involve materials of two different chemical compositions for the two layers 140 and 142. In one example, the layer 142 could be made of relatively abradable mullite while the layer 140 is made of yttria-stabilized zirconia (YSZ) (e.g., 7YSZ) for structural and thermal properties. In one example of a single chemical composition, the layers 140 and 144 are simultaneously cast in a mold. A portion of the mold corresponding to the low density/high porosity inboard layer 142 receives a reticulated or foam sacrificial element. The mold is then filled with ceramic slurry which infiltrates the sacrificial element. The sacrificial element may be removed by heating. For example, a drying and firing process for the ceramic may also vaporize and/or burn off the sacrificial element, leaving porosity. The exemplary YSZ and mullite combination could be made by a similar casting/molding with a sacrificial reticulated element.

Figure 3:
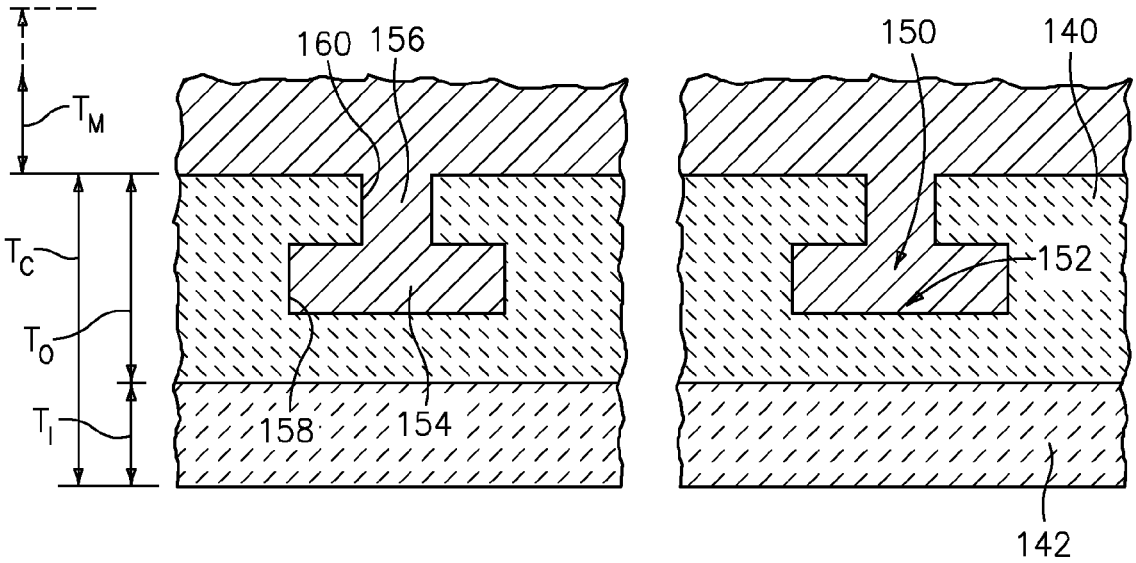
FIG. 3 is an enlarged view of a connection between ceramic and metal members of the BOAS of FIG. 2.

The ceramic member 78 may be attached to the casting. Exemplary attachment is by a macroscopic mechanical interfitting. FIG. 3 shows an exemplary means for interfitting attachment in the form of an array of circumferentially-extending cooperating features. Exemplary cooperating features are rails 150 on the casting 76 interfitting with complementary channels/slots 152 in the ceramic member 78 (e.g., in the outboard layer 140). Exemplary rails 150 are T-sectioned having a head 154 and a leg 156 connecting to a remainder of the casting. Exemplary rails are unitarily formed as a part of the casting 76. Such rails may be cast as rails or may be machined from the casting. Exemplary channels/slots have head 158 and leg 160 portions which may be molded in place (e.g., via additional sacrificial rails placed in the molding die to leave the channels/slots 152 in a similar fashion as the sacrificial element leaves porosity).

With exemplary circumferential rails 150 and slots 152, installation of the ceramic member 78 to the casting 76 may be via a circumferential translation to a final assembled condition/position. Additional securing may be provided to lock the casting and ceramic member in the assembled condition/position. However, even in the absence of such additional securing, assembly of the BOAS ring may allow each segment to help maintain the adjacent segments in the assembled condition/position.

A characteristic overall thickness $T_C$ of the ceramic may be close to an overall characteristic thickness $T_M$ of the casting. For example, exemplary $T_C$ may be 50-150% of $T_M$. Exemplary characteristic $T_C$ may be median or modal. Exemplary $T_M$ may similarly be median or modal and may be overall or taken only along the well. Such values may also represent local relative thicknesses. Exemplary characteristic (e.g., mean, median, or modal, depthwise and/or transverse) by volume porosity of the outboard layer 140 is 1-20%, more narrowly 1-10%. Exemplary characteristic by volume porosity of the inboard layer 142 is 10-60%, more narrowly, 15-60% or 30-60% or 30-40% and at least 10% more (of total rather than just 10% of the 1-20%) by volume than the outboard layer.

Exemplary rail heights (channel/compartment depths) and widths may be within an order of magnitude of ceramic member local thickness (e.g., 10-70%, more narrowly, 20-60%). Exemplary head widths are 150-400% of leg widths.

Where the ceramic member 78 is divided into two layers, each layer may represent an exemplary at least 25% of the combined thickness $T_C$ as a median or modal value. An exemplary denser and less porous outboard layer has a thickness $T_O$ greater than a thickness $T_I$ of the inboard layer. Exemplary $T_O$ is 5 mm (more broadly, 2-10 mm). Exemplary $T_I$ is 0.8 mm (more broadly, 0.5-10 mm). An exemplary combined thickness $T_C$ is at least 4 mm (more narrowly, 5-15 mm).

Figure 4:
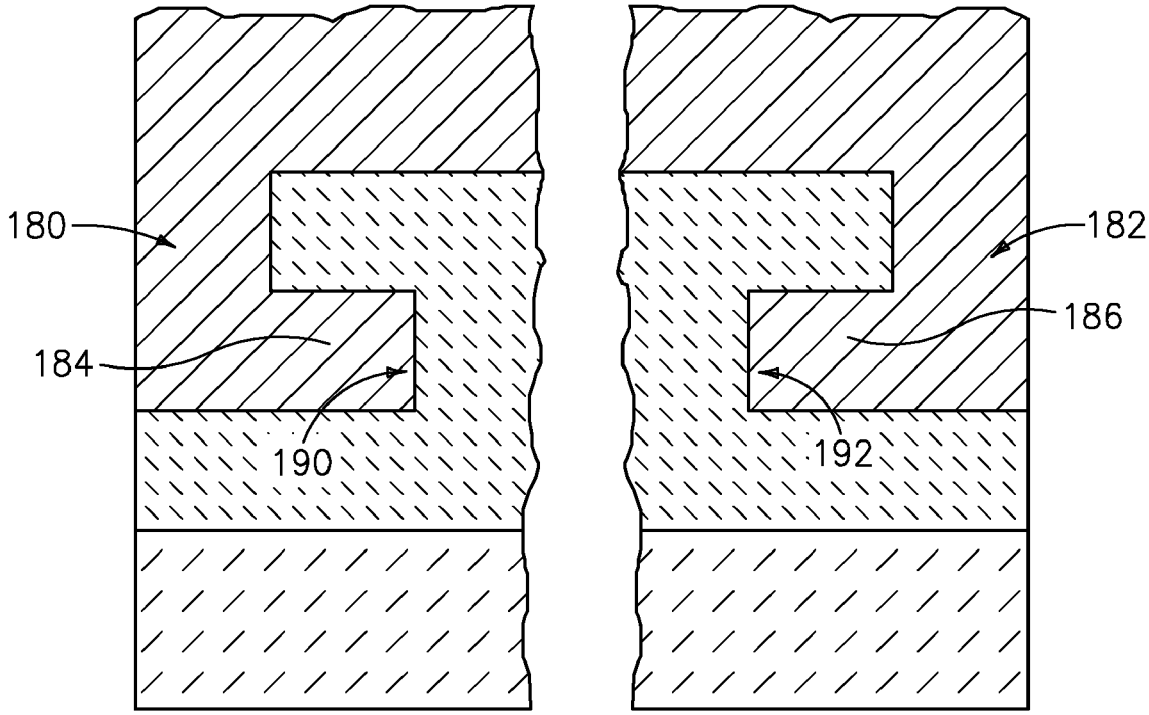
FIG. 4 is an enlarged view of an alternate connection.

Other interfitting attachment geometries and manufacturing techniques are possible. An alternative rail structure involves a pair of perimeter rails 180, 182 (FIG. 4) having opposite inwardly-directed heads 184, 186. For example, the rails may extend circumferentially along the front and rear ends of the casting. The legs and heads may be accommodated in corresponding rebates 190, 192 molded in the ceramic. In one example of a differing manufacturing technique, the rails may be separately-formed from the casting and then secured thereto (e.g., via braze or weld and/or mechanical interfitting).

Figure 5:
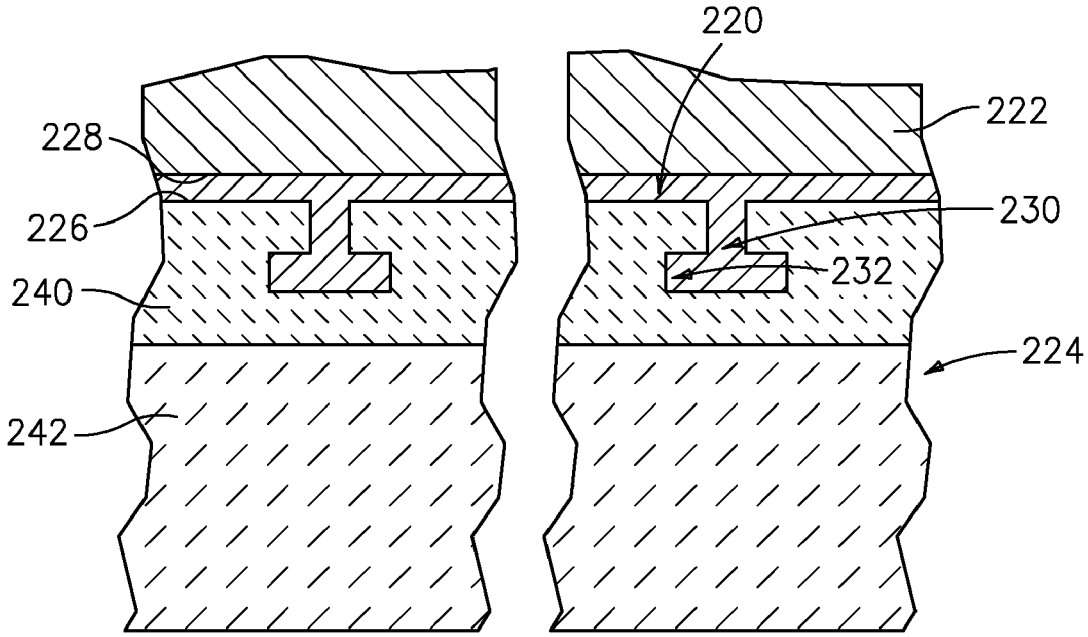
FIG. 5 is an enlarged view of a second alternate connection.

Alternative techniques involve in situ formation of the rails. For example, FIG. 5 shows a braze layer forming 220 an interface between a casting 222 and a ceramic member 224, the interface including rails. In such a situation, the braze material (e.g., paste) may be applied to the facing surface(s) 226, 228 of the ceramic and/or casting and the two brought together into the final assembled position/condition. Heat may be applied to melt the braze material which may then be cooled to form the attachment means. The exemplary attachment means comprises attachment rails 230 formed from the braze material interfitting with slots/channels 232 premolded in the ceramic member 224 as with the FIG. 3 embodiment. The exemplary embodiment also reverses the relative thicknesses of the outboard layer 240 and inboard layer 242. Exemplary diameters (or other transverse dimensions) are similar to widths of corresponding portions of the FIG. 3 embodiment.

Figure 6:
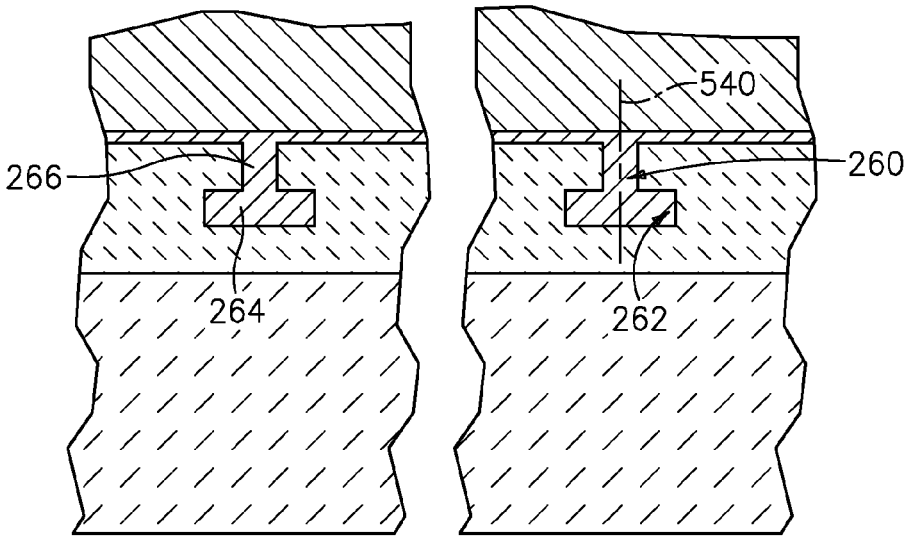
FIG. 6 is an enlarged view of a third alternate connection.

Other variations on the in situ formation of FIG. 5 involve posts in associated compartments of the ceramic member. For example, whereas the channels may be open to one or both opposite edges or ends of the ceramic member, the compartments have a full perimeter. Exemplary posts may have a symmetry around a post axis. FIG. 6 shows a T-section post 260 having an axis 540 and within a complementary compartment 262. The posts 260 have associated head and leg portions 264 and 266, respectively. Exemplary diameters (or other transverse dimensions) are similar to widths of corresponding portions of the FIG. 3 embodiment.

Figure 7:
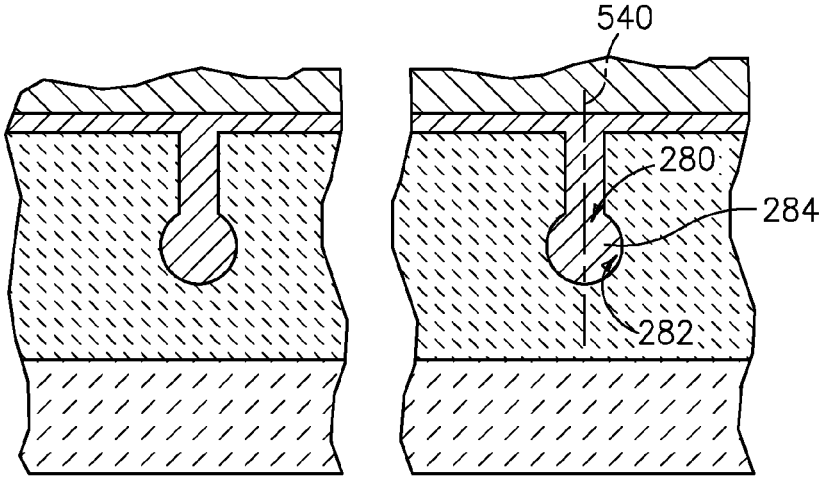
FIG. 7 is an enlarged view of a fourth alternate connection.

FIG. 7 shows an otherwise similar post 280 in a compartment 282. The exemplary post 280 has a spherical head 284. Exemplary diameters (or other transverse dimensions) are similar to widths of corresponding portions of the FIG. 3 embodiment.

Figure 8:
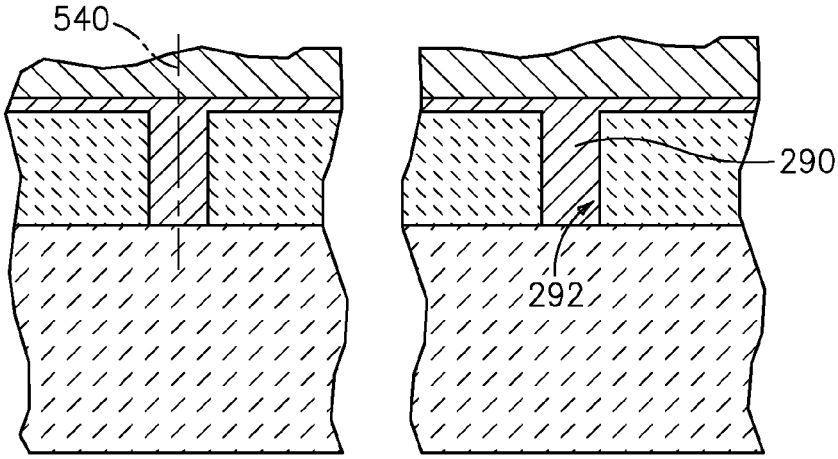
FIG. 8 is an enlarged view of a fifth alternate connection.

FIG. 8 shows a circular cylindrical post 290 in a compartment 292. With a plurality of such cylindrical posts at slightly different angles due to the circumferential curvature of the segment, these different angles may provide the necessary backlocking to radially retain the ceramic member to the casting.

The BOAS may be formed as a reengineering of a baseline BOAS configuration. The BOAS may be implemented in a broader reengineering such as a reengineering of an engine or may be implemented in a clean sheet design. The reengineering may alter the number, form, and/or distribution of the cooling passageways 70. Similarly, in a clean sheet design, there may be a different number, form, and/or distribution of cooling passageways 70 than would be present if existing technology were used. For example, relative to a baseline BOAS or alternative BOAS, the insulation provided by the increased thickness of ceramic (e.g., relative to a thin thermal barrier coating (TBC)) may lead to reduced cooling loads. The reduced cooling loads require reduced total airflow. The reduced airflow may be implemented by reducing the number and/or size (e.g., a total cross-sectional area of the passageways 70). By reducing the cooling air introduced through the various stages of BOAS in a turbine, engine efficiency may be increased. Additionally and/or alternatively, the ceramic member may be used to keep the casting cooler than the casting of the baseline or alternative BOAS. For example, this may allow use of a broader range of materials for the casting, potentially reducing cost and/or providing other performance advantages.

One or more embodiments have been described. Nevertheless, it will be understood that various modifications may be made without departing from the spirit and scope of the invention. For example, when implemented in the reengineering of a baseline BOAS, or using existing manufacturing techniques and equipment, details of the baseline BOAS or existing techniques or equipment may influence details of any particular implementation. Accordingly, other embodiments are within the scope of the following claims.

What is claimed is:

1. A turbine engine blade outer air seal segment comprising:
- a body having:
  - a base portion having:
    - a transversely concave inner diameter (ID) face;
    - a forward end;
    - an aft end; and
    - first and second circumferential edges; and
  - at least one mounting hook,
- wherein:
- the body comprises a metallic member and a pre-formed ceramic member;
- the ceramic member and metallic member are joined along the base portion with the ceramic member inboard of the metallic member; and
- the ceramic member and metallic member are so joined by a braze, the braze forming at least one projection interfitting with a complementary feature of the ceramic member.

2. The turbine engine blade outer air seal segment of claim 1 wherein:
- the projections are posts.

3. The turbine engine blade outer air seal segment of claim 1 wherein:
- the ceramic member has a characteristic average thickness of at least 4 mm.

4. The turbine engine blade outer air seal segment of claim 1 wherein:
- the ceramic member includes an outboard layer distinct from an inboard layer and having a different porosity.

5. The turbine engine blade outer air seal segment of claim 4 wherein:
- each of the inboard layer and outboard layer represents at least 25% of a characteristic thickness of the ceramic member.

6. The turbine engine blade outer air seal segment of claim 4 wherein:
- the inboard layer porosity is greater than the outboard layer porosity by at least 10% by volume porosity.

7. The turbine engine blade outer air seal segment of claim 4 wherein:
- the inboard layer consists essentially of mullite; and
- the outboard layer consists essentially of 7YSZ.

8. The turbine engine blade outer air seal segment of claim 4 wherein:
- the inboard layer is of a different chemical composition than the outboard layer.

9. The turbine engine blade outer air seal segment of claim 1 wherein:
- a median thickness of the ceramic member is 50-150% of a median thickness of the metallic member.

10. The turbine engine blade outer air seal segment of claim 1 wherein at at least one location:
- a thickness of the ceramic member is 50-150% of a thickness of the metallic member.

11. The turbine engine blade outer air seal segment of claim 1 wherein:
- a median thickness of the ceramic member is 5-15 mm.

12. The turbine engine blade outer air seal segment of claim 1 further comprising:
- at least one cover plate secured to the body to define at least one cavity and having a plurality of feed holes.

13. The turbine engine blade outer air seal segment of claim 1 wherein:
- a plurality of outlet holes extend through the base portion to the ID face.

14. The turbine engine blade outer air seal segment of claim 1 wherein:
- the at least one mounting hook includes:
- at least one front mounting hook; and
- at least one aft mounting hook.

15. A method for manufacturing a turbine engine blade outer air seal segment, the method comprising:
- pre-forming a metallic body having:
  - a base portion having:
    - an ID face;
    - a forward end;
    - an aft end;
    - a first circumferential edge;

a second circumferential edge; and
at least one mounting hook;

forming a ceramic member having:
an outer diameter (OD) face;
a transversely concave inner diameter (ID) face;
a forward end;
an aft end;
a first circumferential edge;
a second circumferential edge; and
at least one engagement feature along the OD face of the ceramic member; and securing the ceramic member to the base portion ID face via the at least one engagement feature, wherein:

the forming of the ceramic member comprises:
positioning a first sacrificial element in a mold;
positioning a second sacrificial element in the mold;
introducing a slurry to the mold;
hardening the slurry; and destructively removing the first sacrificial element to leave porosity and the second sacrificial element to leave the engagement feature.

16. The method of claim 15 wherein the securing comprises:

forming at least one mating feature on the base portion ID face cooperating with the engagement feature of the ceramic member.

17. The method of claim 16 wherein:

the forming of the mating feature comprises brazing.

18. The method of claim 15 wherein:

the forming of the body forms a mating feature on the base portion ID face; and the assembling engages the mating feature with the engagement feature.

19. The method of claim 18 wherein:

the assembling comprises a shift of the mating feature along the engagement feature.

20. A turbine engine blade outer air seal segment comprising:

a metallic member;

a pre-formed ceramic member joined to the metallic member inboard of the metallic member and having:
a transversely concave inner diameter (ID) face;
an outer diameter (OD) face;
at least one engagement feature along the OD face;
a forward end;
an aft end; and
first and second circumferential edges; and
a braze extending from the metallic member into the engagement feature.

* * * * *